US006923227B2

(12) United States Patent
Robitaille

(10) Patent No.: US 6,923,227 B2
(45) Date of Patent: Aug. 2, 2005

(54) CANTER CHIPPER HEAD

(75) Inventor: Pascal Robitaille, Lasarre (CA)

(73) Assignee: Equipement Hydraulique Boreal Inc., Macamic (CA)

( * ) Notice: Subject to any disclaimer, the term of this patent is extended or adjusted under 35 U.S.C. 154(b) by 35 days.

(21) Appl. No.: 10/134,383

(22) Filed: Apr. 30, 2002

(65) Prior Publication Data

US 2003/0201029 A1 Oct. 30, 2003

(51) Int. Cl.[7] ..... B27C 1/00; B26D 1/143

(52) U.S. Cl. ..... 144/176; 144/220; 144/235; 407/42; 407/60; 407/61

(58) Field of Search ..... 144/235, 236, 144/220, 241, 176, 218, 39, 162.1; 409/132, 232, 234, 137, 144, 228; 407/34, 35, 36, 44, 45, 29, 42, 56, 58, 60, 61; 83/853

(56) References Cited

U.S. PATENT DOCUMENTS

| | | | | |
|---|---|---|---|---|
| 178,918 A | * | 6/1876 | Finn | 144/235 |
| 1,472,960 A | * | 11/1923 | Conklin | 407/29 |
| 2,540,530 A | | 2/1951 | Johnson | |
| 2,899,992 A | | 8/1959 | Key | |
| 2,922,448 A | * | 1/1960 | Standal | 144/219 |
| 3,297,067 A | * | 1/1967 | Zaichkowsky | 144/176 |
| 3,881,662 A | * | 5/1975 | Gunnarsson | 241/221 |
| 4,456,045 A | | 6/1984 | Gregoire | |
| 4,690,186 A | | 9/1987 | Chapman | |
| 4,793,390 A | * | 12/1988 | Stroud | 144/39 |
| 5,271,442 A | | 12/1993 | Carpenter et al. | |
| 5,439,039 A | | 8/1995 | Bradstreet, Jr. et al. | |
| 5,505,239 A | | 4/1996 | Sparks | |
| 5,511,597 A | | 4/1996 | Shantie et al. | |
| 5,613,538 A | | 3/1997 | Brisson | |
| 5,617,908 A | * | 4/1997 | Toogood | 144/218 |
| 5,709,255 A | * | 1/1998 | Toogood | 144/220 |
| 5,816,301 A | | 10/1998 | Stager | |
| 5,915,429 A | | 6/1999 | Pelletier et al. | |
| 5,983,967 A | | 11/1999 | Gross et al. | |
| 5,996,655 A | | 12/1999 | Cramond et al. | |

FOREIGN PATENT DOCUMENTS

| | | |
|---|---|---|
| CA | 2177745 | 11/2000 |
| CA | 2314718 | 8/2001 |
| CA | 2307408 | 11/2001 |

* cited by examiner

*Primary Examiner*—Derris H. Banks
*Assistant Examiner*—Shelley Self

(57) ABSTRACT

The present invention provides a canter chipper head that comprises a rotor suitable for rotation about a rotation axis. The rotor has a lateral side and a frontal side, and includes a first cutting assembly and a second cutting assembly that are each mounted to the rotor. During rotation, the first cutting assembly defines a first lateral cutting surface around the rotation axis, and a first frontal cutting surface that is generally transverse to the rotation axis. The first lateral cutting surface and the first frontal cutting surface perform a primary cut in a log. The second cutting assembly defines a second lateral cutting surface around the rotation axis, and a second frontal cutting surface that is generally transverse to the rotation axis. The second lateral cutting surface and the second frontal cutting surface perform a secondary cut in the log that is deeper than the primary cut.

22 Claims, 9 Drawing Sheets

CANTER CHIPPER HEAD

FIELD OF THE INVENTION

The present invention relates to canter chipper heads used for producing chips and square pieces of lumber from a log. More particularly, the present invention relates to canter chipper heads having improved cutting and finishing cutting surfaces.

BACKGROUND OF THE INVENTION

Canter chipper heads for processing logs in order to produce wood chips and square pieces of lumber are known in the art. An example of such a canter chipper head can be seen in Canadian Patent 2,314,718 issued on Aug. 21, 2001 to Pelletier et al.

Chips that are produced from canter chipper heads have many uses. Therefore, when forming wood chips it is required that the chips are of a certain consistency and quality. There are a number of factors involved in the production of quality chips, one such factor is the canter chipper head design and more specifically, the cutting surface design of the head.

A deficiency with many canter chipper heads, such as the one described in Canadian Patent 2,314,718, is that the chipper head has only a single cutting assembly for performing both the chip cutting and the finishing of the piece of lumber. This puts a significant amount of stress on the blades of the cutting assembly, which results in an inconsistency in the quality of the chips being produced, and a shorter life span for the cutting assembly.

Therefore, based on the above described deficiencies with the prior art, there is a need in the industry for an improved cutting surface for canter chipper heads.

SUMMARY OF THE INVENTION

As embodied and broadly described herein, the present invention provides a canter chipper head that comprises a rotor suitable for rotation about a rotation axis. The rotor has a lateral side and a frontal side. The chipper head further includes a first cutting assembly and a second cutting assembly that are each mounted to the rotor. During rotation of the rotor about the rotation axis, the first cutting assembly defines a first lateral cutting surface around the rotation axis and a first frontal cutting surface that is generally transverse to the rotation axis. The first lateral cutting surface and the first frontal cutting surface perform a primary cut in a log. The second cutting assembly defines a second lateral cutting surface around the rotation axis and a second frontal cutting surface that is generally transverse to the rotation axis. The second lateral cutting surface and the second frontal cutting surface perform a secondary cut in the log that is deeper than the primary cut.

This dual step cutting operation is advantageous for a number of reasons, namely it provides a lumber with a surface having a superior finish, reduction of vibrations while the head is performing the cutting and a reduction of the cutting force.

As further embodied and broadly described herein, the present invention provides a canter chipper head that comprises a rotor that is suitable for rotation about a rotation axis. The rotor has a lateral side and a frontal side. The canter chipper head further comprises a cutting assembly mounted to the rotor. During rotation of the rotor about the rotation axis, the cutting assembly defines a lateral cutting surface around the rotation axis and a frontal cutting surface that is generally transverse to the rotation axis. The frontal cutting surface has a radially inward cutting surface and a radially outward cutting surface. The radially outward cutting surface performs a first frontal cut in a log and the radially inward cutting surface performs a second frontal cut in the log that is deeper than the first frontal cut.

As further embodied and broadly described herein, the present invention provides a canter chipper head that comprises a rotor that is suitable for rotation about a rotation axis, and a cutting assembly that includes a blade having a plurality of contiguous segments mounted on the rotor at progressively decreasing angles of attack.

As still further embodied and broadly described herein, the present invention provides a canter chipper head that comprises a rotor suitable for rotation about a rotation axis, and a cutting assembly that includes a blade having a cutting edge with a variable angle of attack there along.

BRIEF DESCRIPTION OF THE DRAWINGS

A detailed description of examples of implementation of the present invention is provided hereinbelow with reference to the following drawings, in which.

Figure 1:
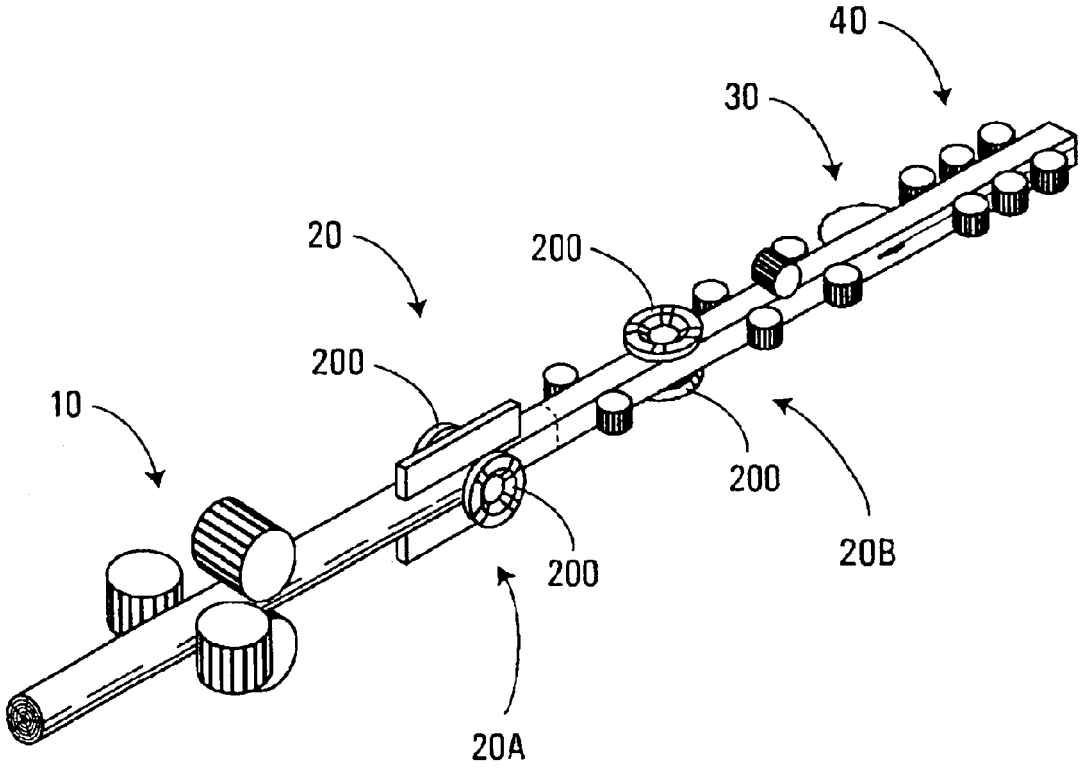
FIG. 1 is a diagrammatic view of the components of a compact saw mill in which can be used a canter chipper head in accordance with the present invention.

In the drawings, embodiments of the invention are illustrated by way of example. It is to be expressly understood that the description and drawings are only for the purposes of illustration and as an aid to understanding, and are not intended to be a definition of the limits of the invention.

DETAILED DESCRIPTION

The present invention relates to a canter chipper head for use in a compact sawmill, similar to that shown in FIG. 1. A typical compact sawmill, such as the one shown in FIG. 1, comprises the following processing and handling components:

a) An in-feed section 10 in which there is a first and a second pair of large diameter power driven feed rolls for propelling a log endwise along a pre-selected feed path;
b) A canting section 20 in which there is a first and a second pair of canter chipper heads 200, which will be described in detail further on in the specification, and which are offset 90 degrees from one another about the axis of the feed path;
c) A timber sub-dividing or sawing section 30; and
d) A lumber out-feed conveyor section 40 made up of a plurality of small diameter power driven feed rolls for engaging the flat faces of a squared timber piece to guide and propel it along the pre-selected feed path.

The canting section 20 has a first canting section 20A and a second canting section 20B that are spaced apart along the pre-selected feed path. The first canting section 20A comprises a pair of oppositely facing canter chipper heads 200, that produce a pair of parallel vertically disposed flat faces on a log that is propelled endwise through its pre-selected path by the power driven, rollers. The second canting section 20B produces a pair of horizontally disposed flat faces, thereby producing a square or rectangular piece of lumber from the initial log. The two canting sections 20A and 20B are the same except for their orientation relative to the log about the longitudinal axis of the feed path.

Each canting section 20 has a pair of canter chipper heads 200. The construction of each canter chipper head 200 is the same and, therefore, for simplicity, only one canter chipper head 200 is described in detail in this specification.

Figure 2:
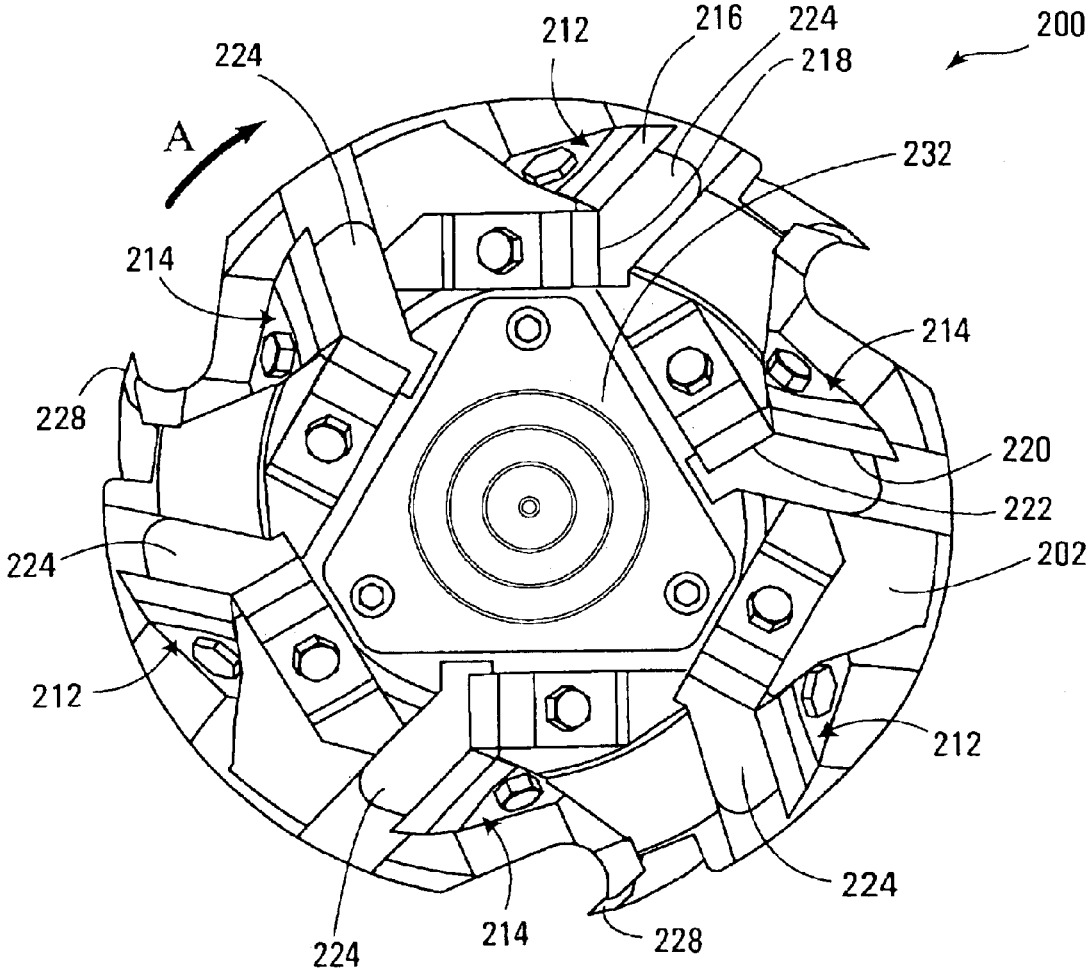
FIG. 2 is a front view of a canter chipper head in accordance with a specific embodiment of the present invention.
Figure 4:
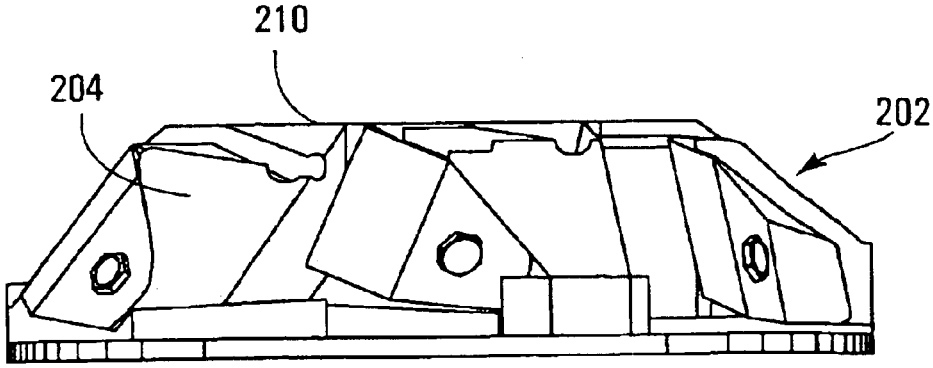
FIG. 4 is side view of the canter chipper head as shown in FIG. 2.

FIG. 2 shows a front view of a canter chipper head 200 in accordance with a first specific embodiment of the present invention. Canter chipper head 200 includes a rotor 202. In a preferred embodiment, and as shown in FIG. 4 rotor 202 is formed in a generally frusto-conical shape with a lateral side 204 and a frontal side 210. Note that the frusto-conical shape is not critical and other shapes can be considered without departing from the spirit of the invention.

Figure 6:
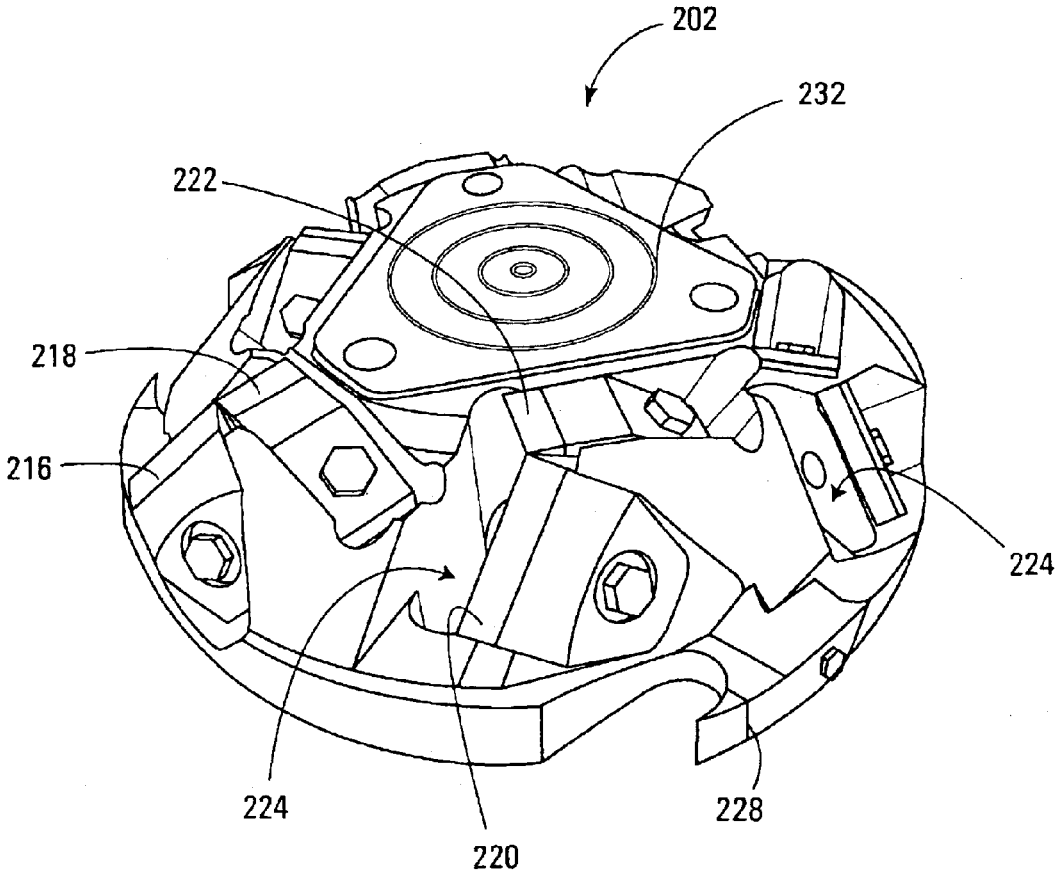
FIG. 6 is a front perspective view of the canter chipper head as shown in FIG. 2.

Rotor 202 is suitable for being removably secured to a drive shaft that is journalled for rotation in a housing. In a non-limiting example of implementation, the shaft is connected to rotor 202 by inserting the shaft within recess 230, shown in FIG. 7, and attaching the rotor 202 and shaft together using screws. The screws are screwed into the shaft from the frontal side 210 of rotor 202, and as shown in FIG. 6, a triangular plate 232 is positioned on the frontal side 210 in order to cover the heads of the screws. As the shaft is rotated, rotor 202 is caused to rotate about a central rotation axis that is preferably co-axial with the central longitudinal axis of the shaft.

As shown in FIG. 2, positioned around the lower circumference of rotor 202 are three equally spaced teeth cutters 228. As rotor 202 rotates about its rotation axis, if there are any irregularities in the log such as remaining branches or protruding pieces of wood, teeth cutters 228 are the first things to come into contact with the log, in order to remove the irregularities. It should be understood that if the log is of a substantially uniform cylindrical shape, then teeth cutters 228 may not cut any material from the log. The teeth cutters 228 can be integrally formed with rotor 202 or may be detachably mounted to rotor 202 such that they can be sharpened or disposed of.

In addition to teeth cutters 228, the canter chipper head 200 includes a first cutting assembly, and a second cutting assembly, both cutting assemblies being mounted to rotor 202. The first cutting assembly includes three blade sub-assemblies 212. Each blade sub-assembly 212 includes a blade 216 and a blade 218. The second cutting assembly includes three blade sub-assemblies 212. Each blade sub-assembly includes blades 220 and 222. In an alternative embodiment, each cutting assembly may include more or less than three blade sub-assemblies.

As can be seen in FIG. 6, the three blades 216 and the three blades 220 are mounted to the lateral side 204 of rotor 202, and the three blades 218 and the three blades 222 are mounted to the frontal side 210 of rotor 202. In a specific example of implementation a blade 216 and a blade 218 of a common blade sub-assembly are positioned contiguously i.e., they are located on a common radius originating at the center of the rotor 202, even though they are in different planes and angularly disposed relative to one another. Similarly, a blade 220 and a blade 222 of a common blade sub-assembly are positioned contiguously i.e., they are located on a common radius originating at the center of the rotor 202, even though they are in different planes and angularly disposed relative to one another. It should be noted that it is not essential for the blades in a blade sub-assembly to be contiguously positioned. For instance, it may be envisaged to locate the blades such that they are angularly spaced from one anther (each blade is aligned with a different radius on the rotor). Another possibility is to locate the blades such that they are aligned on a common radius, however their longitudinal extremities are not in contact with one another.

Figure 5:
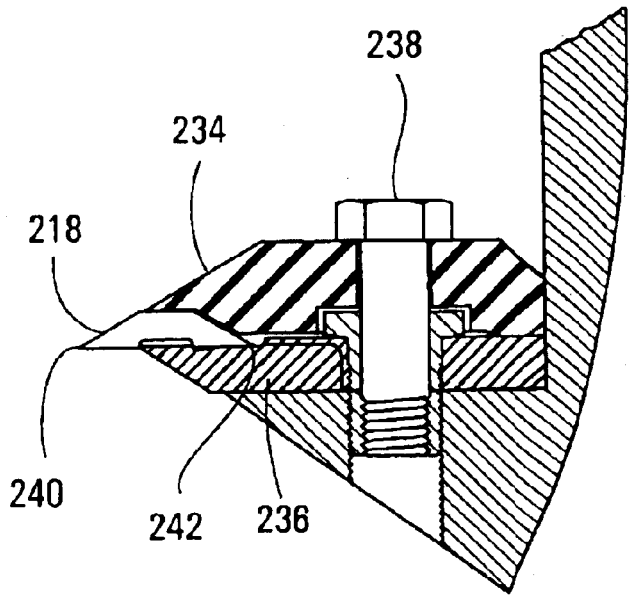
FIG. 5 is a side view of a mounting arrangement for mounting cutting blades.

In a preferred embodiment, blades 216, 218, 220 and 222 are detachably secured to rotor 202 such that they can be re-sharpened or disposed of. The blades can be detachably secured to rotor 202 using any technique known in the art, such as by bolting them directly to rotor 202, or by clamping them between a bottom plate and a top clamping plate that are then bolted to rotor 202. An example of this implementation is shown in FIG. 5. The blade 218 is clamped between a top clamping plate 234 and a bottom clamping plate 236. Both plates are mounted to the rotor by a bolt 238 threadedly engaged in the rotor 202. It will be noted that the blade 218 has two cutting edges 240 and 242. When one of the cutting edges 240, 242 is dulled, the blade 218 is removed and mounted in the opposite position to expose the sharp cutting edge 240, 242. The same mounting arrangement is used for all the blades mounted on the rotor 202. The only difference is that in the case of longer blades, such as the blades 216, the blade is made up of two or more individual smaller blades, such as blade 218, for example. This modular approach facilitates manufacturing and maintenance. Other blade mounting arrangements can be used without departing from the spirit of the invention.

Figure 7:
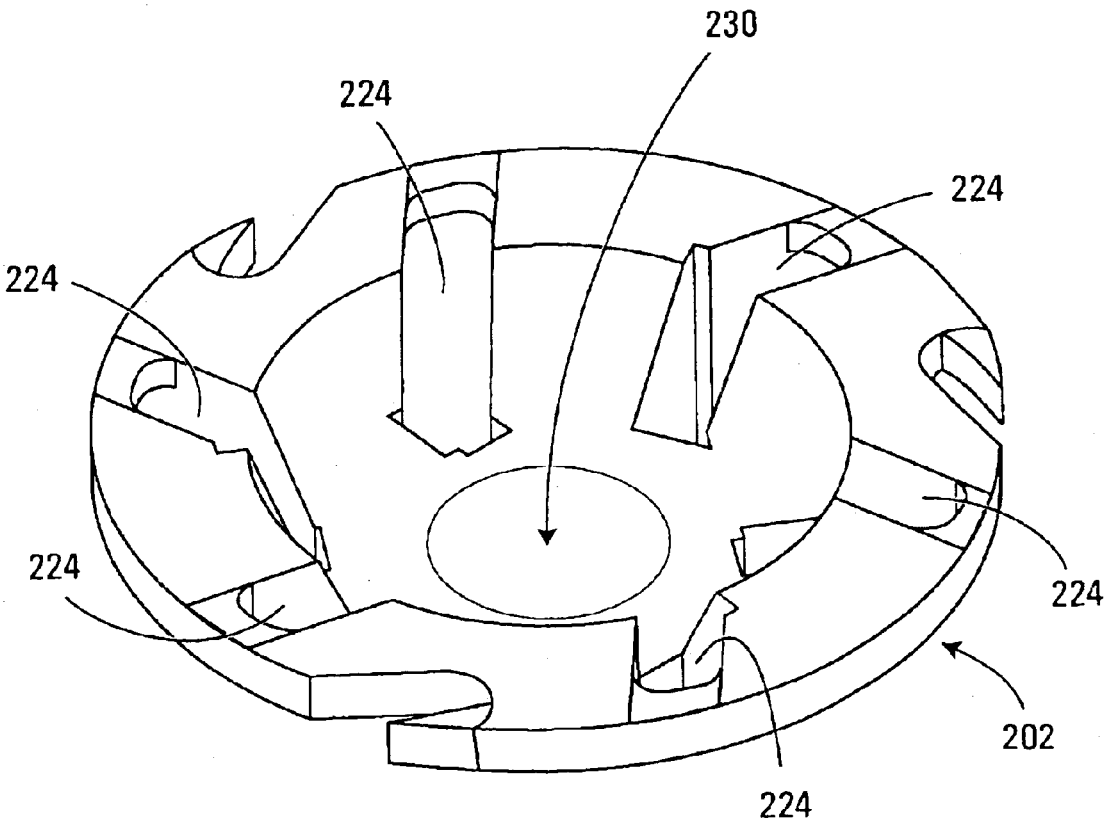
FIG. 7 is a back perspective of the canter chipper head as shown in FIG. 2.
Figure 8:
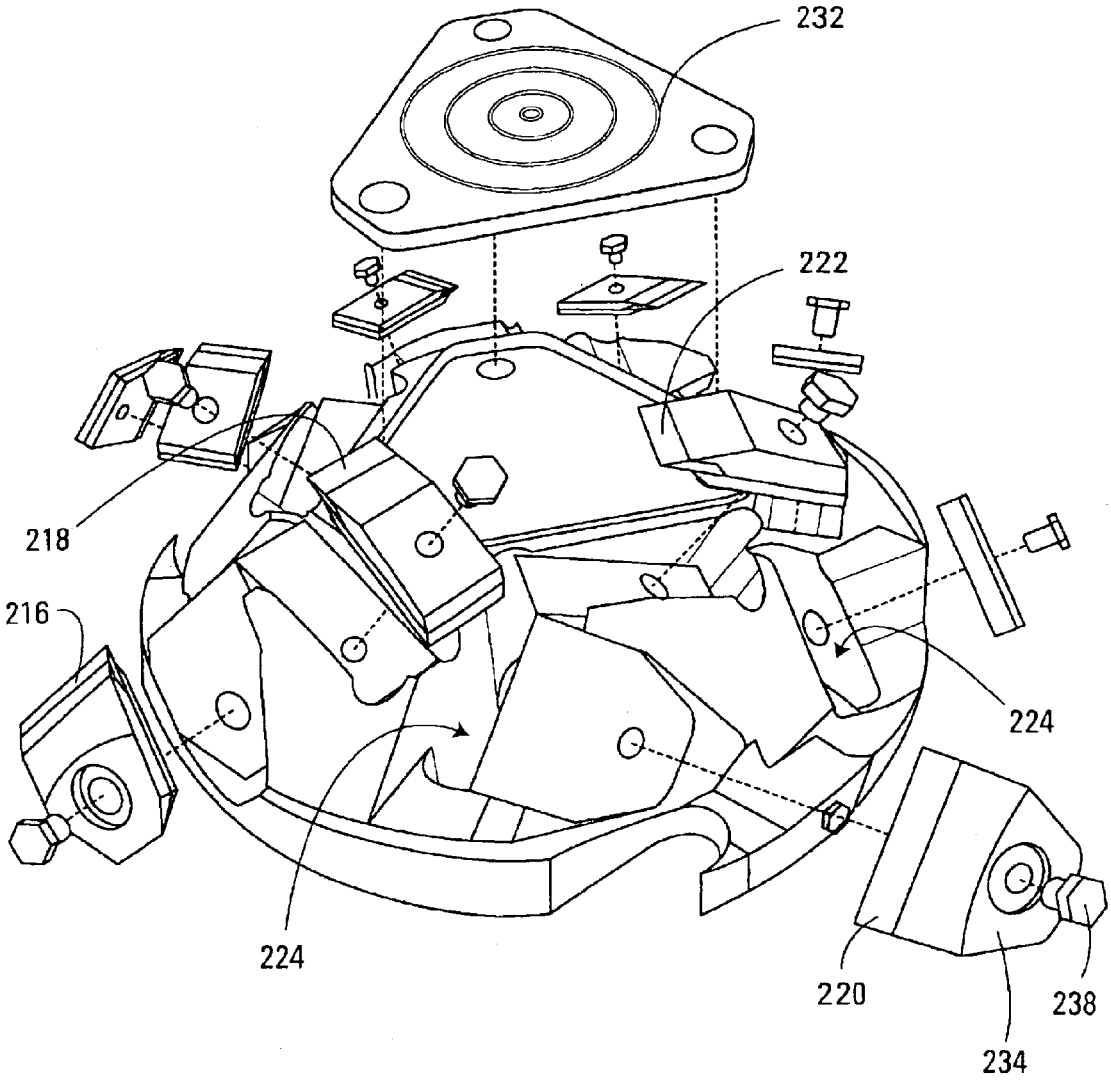
FIG. 8 is an exploded perspective view of the canter chipper head as shown in FIG. 2.

As shown in FIGS. 2 and 6, rotor 202 further comprises a chip-discarding aperture 224 in front of each blade sub-assembly 212, 214. The chip discarding apertures 224 extend from the lateral sides 203 and frontal sides 210 of rotor 202 to the back side of rotor 202, as can be seen in FIG. 7. Blades 216, 218, 220 and 222 project into apertures 224 from the body of rotor 202.

Figure 3:
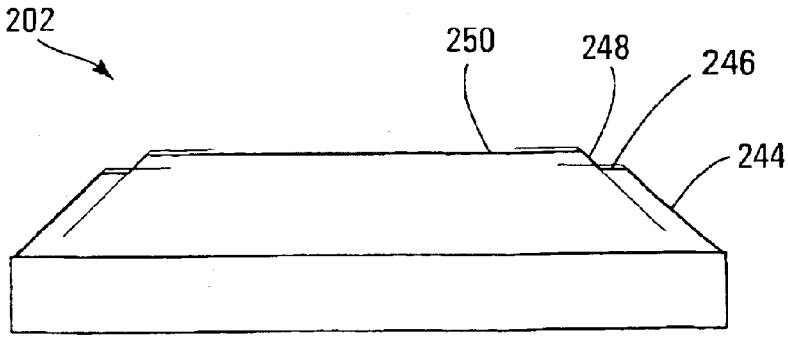
FIG. 3 is a side view of the cutting surfaces defined by the canter chipper head of FIG. 2.

Referring to FIG. 3, it is shown that during the rotation of rotor 202 about its rotation axis, the first cutting assembly defines a first lateral cutting surface 244 around the rotation axis and a first frontal cutting surface 246 that is generally transverse to the rotation axis. The first lateral cutting surface 244 is the surface swept by blades 216 as the rotor 202 rotates, and therefore is of a generally frusto-conical shape. The first frontal cutting surface 246 is the generally annular shaped surface swept by blades 218 as rotor 202 rotates.

Furthermore, during rotation of rotor 202, the second cutting assembly defines a second lateral cutting surface 248 around the rotation axis and a second frontal cutting surface 250 that is generally transverse to the rotation axis. The second lateral cutting surface 248 is the surface swept by the blades 220 as the rotor 202 rotates, and therefore is also of a generally frusto-conical shape. The second frontal cutting surface 250 is the generally annular shaped surface swept by blades 222 as rotor 202 rotates.

As can be seen in FIG. 3, the second lateral cutting surface 248 is offset both radially inwardly and in a direction along the rotation axis, in relation to the first lateral cutting surface 244. In addition, the first frontal cutting surface 246 is offset radially outwardly and in a direction along the rotation axis, in relation to the second frontal cutting surface 250.

In order to obtain the cutting surfaces described earlier, the various blades are mounted at different positions on the rotor 202. As shown in FIG. 6, the blades 216, 218 of the first cutting assembly are positioned lower and radially outwardly from blades 220, 222 of the second cutting assembly. As such, blades 116 and 118 of the first cutting assembly are able to form the first lateral cutting surface 244 and first frontal cutting surface 246 as shown in FIG. 3. The blades 220, 222 of the second cutting assembly are positioned above and radially inwardly from the blades 216 and 218 of the first cutting assembly, and as such, are able to form the second lateral cutting surface 248 and second frontal cutting surface 250 as shown in FIG. 3.

Therefore, as a log is passed through the pre-selected path defined by the sawmill to the canter chipper head 200, the first lateral cutting surface 244 and the first frontal cutting surface 246 make a primary cut into the log. As the log continues along its path, the second lateral cutting surface 248 and the second frontal cutting surface 250 make a secondary cut into the log that is deeper than the primary cut, meaning that the secondary cut removes more material from the log than the primary cut.

It is within the reach of a person skilled in the art to determine the precise blade dimensions and the locations of the various blades on the rotor 202, according to the specific application.

Figure 9:
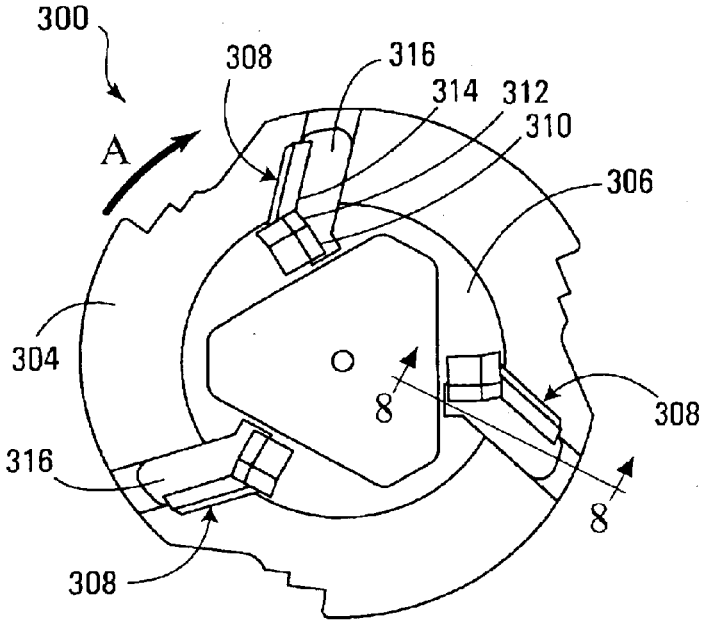
FIG. 9 is a front view of a canter chipper head in accordance with a second specific embodiment of the present invention.

Shown in FIG. 9 is a canter chipper head 300 in accordance with a second specific embodiment of the present invention. Canter chipper head 300 includes a rotor 302 that includes a lateral side 304 and a frontal side 306. Rotor 302 is adapted to be connected to a rotating shaft in the same manner as described above with respect to rotor 202. As such, rotor 302 is able to rotate about a central rotation axis.

Mounted to rotor 302 is a cutting assembly that has three blade sub-assemblies 308. Each blade sub-assembly 308 has a lateral blade 314 and a frontal blade that is made up of a radially inward segment 310 and a radially outward segment 312. The radially inward segment 310 and the radially outward segment 312 of the frontal blade can be different segments of a single blade, or can be two separate blade segments that are positioned in relation to each other. Preferably, the lateral blades and the frontal blades are removably mounted to rotor 302, as discussed earlier.

As can be seen in FIG. 9, radially outward segments 312 are slanted backwardly relative to the radially inward segments 310, about the direction of rotation of rotor 302. Each radially outward segment 312 of the frontal blade extends from the radially inward segment 310 to the corresponding lateral blade 314. The direction of rotation of rotor 302 about its rotation axis is shown by arrow A in FIG. 9.

In a specific and non-limiting example of implementation the backward slant of the cutting edge of the radially outward segment 312 with relation of the cutting edge of the radially inward segment 310 is of approximately 5 degrees.

Figure 10:
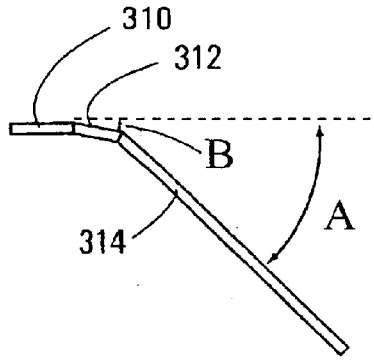
FIG. 10 is a cross-sectional view of the canter chipper head of FIG. 9, taken along line 10—10 as shown in FIG. 9.
Figure 11:
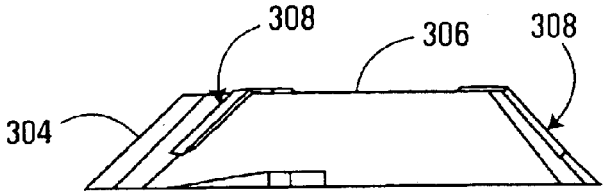
FIG. 11 is a side view of the canter chipper head as shown in FIG. 9.

As shown in FIG. 10, the lateral blade 314 is angularly offset from the radially inward segment 310 at an angle (angle A). In the non-limiting example of implementation shown, angle A is of approximately 45 degrees. Radially outward segment 312 is also positioned at an angle (angle B) from the radially inward segment 310 of the frontal blade. Angle B is smaller than angle A. In the non-limiting example of implementation shown, angle B is of approximately 5 degrees with respect to the radially inward segment 310. It should be understood that other angles, different from the ones mentioned above, are possible without departing from the spirit of the invention Positioned in front of each blade sub-assembly 308 is a chip-discharging aperture 316, through which chips are discharged. The blades of the sub-assemblies 308 project slightly into the chip dispensing apertures 316.

Figure 12:
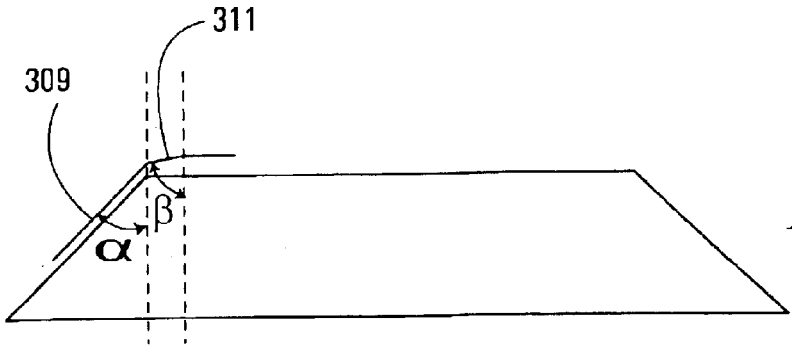
FIG. 12 is a side view of the cutting surfaces defined by the canter chipper head of FIG. 9.

As shown in FIG. 12, during rotation of rotor 302, the blade sub-assemblies 308 define a lateral cutting surface 309 around the rotation axis, and a frontal cutting surface generally transverse to the rotation axis. The lateral cutting surface 309 is the surface swept by lateral blades 314 as rotor 302 rotates, and therefore is of a generally frusto-conical shape. The frontal cutting surface 311, which is generally transverse to the rotation axis is the surface swept by the two segments of the frontal blade as rotor 302 rotates. The frontal cutting surface 309 has an inward cutting surface and an outward cutting surface. The outward cutting surface is the frusto conical surface defined by radially outward segments 312 as rotor 302 rotates, and the radially inward cutting surface is the annular surface defined by radially inward segments 310 of the frontal blade as rotor 302 rotates. The lateral cutting surface 309 defines a smaller angle $\alpha$ with relation to the rotation axis, than the angle $\beta$ defined between the outward cutting surface and the rotation axis. The outward cutting surface is the frusto conical surface defined by radially outward segments 312 as rotor 302 rotates, and the radially inward cutting surface is the annular surface defined by radially inward segments 310 of the frontal blade as rotor 302 rotates.

As a log is passed through the pre-selected path past the canter chipper head 300, the lateral cutting surface makes a lateral cut into the log that produces chips of wood. As the log continues along its path, the radially outward cutting surface makes a first frontal cut in the log, followed by a second frontal cut that is made by the radially inward cutting surface. The second frontal cut is deeper than the first frontal cut, meaning that the radially inward cutting surface removes more material from the piece of lumber. An advantage of having a radially outward cutting surface that is swept back and angularly offset from the inward cutting surface is that the pressure on the junction between the frontal blades and the lateral blades is reduced, resulting in a better surface finish on the lumber.

Figure 13:
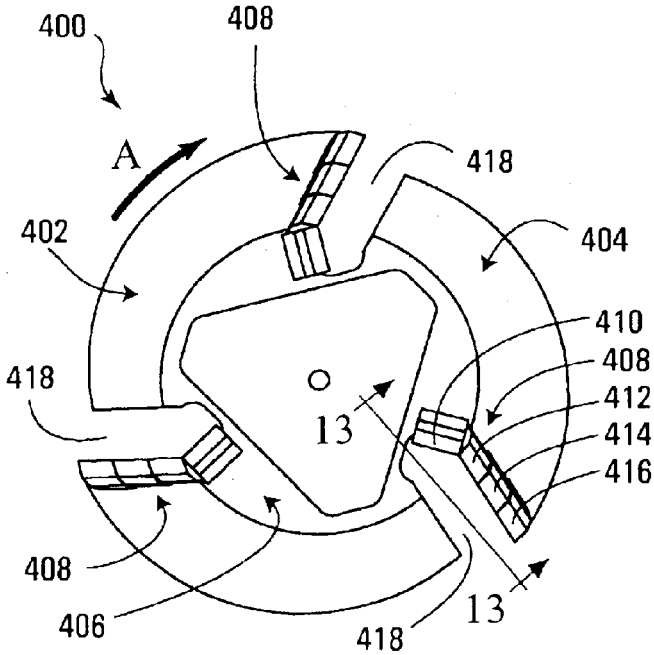
FIG. 13 is a front view of a canter chipper head in accordance with a third specific embodiment of the present invention.

Shown in FIG. 13 is a canter chipper head 400 in accordance with a third specific embodiment of the present invention. Canter chipper head 400 includes a rotor 402 that includes a lateral side 404 and a frontal side 406.

Figure 14:
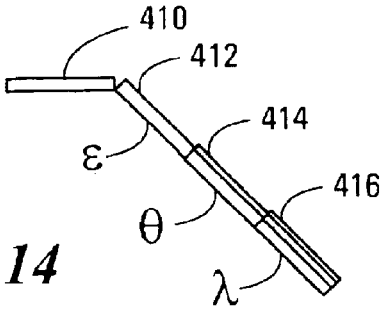
FIG. 14 is a cross-sectional view of the canter chipper head of FIG. 13, taken along line 13—13 as shown in FIG. 13.

Mounted to rotor 402 is a cutting assembly having three blade sub-assemblies 408. Each blade sub-assembly 408 includes a frontal blade 410, mounted to the frontal side 406, and a lateral blade having a plurality of contiguous segments 412, 414 and 416, each mounted to the lateral side 404. In a preferred embodiment, the plurality of contiguous segments 412, 414 and 416 are identical blade segments that are positioned at progressively decreasing angles of attack in relation to each other. It should be understood that each blade segment does not need to be identical to the others. The angle of attack decreases in a direction from the top to the base of the frusto-conical shaped cutting surface swept by the lateral blade. In other words, the angle of attack decreases toward the tip of the lateral blade which travels faster than the root of the blade. As shown in FIG. 14, segment 412 is positioned at an angle of attack $\epsilon$, segment 414 is positioned at an angle of attack $\theta$, that is less than angle $\epsilon$ and segment 416 is positioned at an angle of attack $\lambda$ that is less than both of angles $\epsilon$ and $\lambda$. The blade segment 416 travels faster than the blade segment 414.

Preferably, the blades of each cutting assembly 408 are removably mounted to rotor 402, such that the blades may be disposed of or re-sharpened. The blades can be removably mounted to rotor 402 using any suitable technique, such as the ones described earlier.

Figure 15:
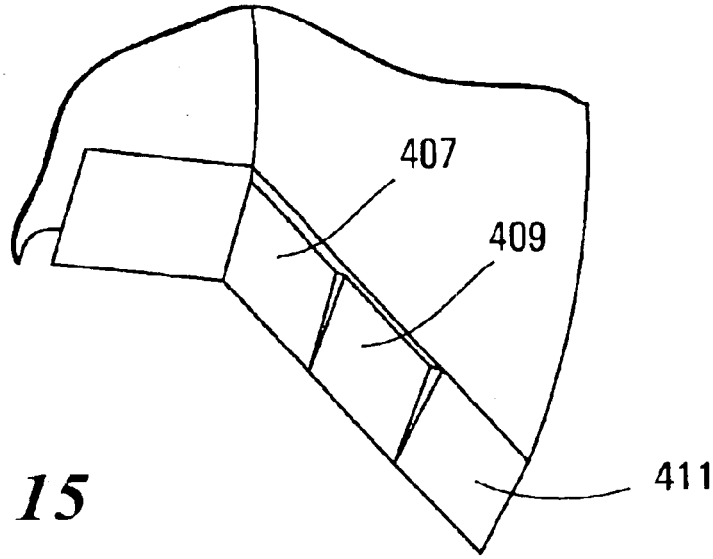
FIG. 15 is perspective view of a mounting arrangement for the canter chipper head of FIG. 13.

In a specific example of implementation, blade segments 412, 414 and 416 are removably mounted to rotor 402. As such, in a non-limiting embodiment blade segments 412, 414 and 416 can be disposable. In a specific example of implementation, in order to mount the segments 412, 414 and 416 to rotor 402, the blade mounting arrangement shown at FIG. 15 is used. Specifically, the blade mounting arrangement includes a plurality of seats 407, 409 and 411 for the blade segments. It should be understood that more or less than three seats can be utilized without departing from the spirit of the invention. In order to obtain the variable angle of attack, each seat is machined such as to hold a blade at a slightly different position with relation to the adjacent blades. Optionally, the seats on the rotor 402 can be machined such as to locate each mounting arrangement in a different special position to obtain the variable angle of attack along the lateral blade edge.

Positioned in front of each cutting assembly 408 is a chip-discharge channel 418, through which chips can travel. The blades of blade sub-assemblies 408 project slightly into their respective chip discharge channels 418. Although a channel is shown in FIG. 13, it should be expressly understood that an aperture as shown with respect to rotor 202 or 302 could also be used.

During rotation of rotor 402, the cutting assemblies 408 define a generally frusto-conical lateral cutting surface around the rotation axis, and a frontal cutting surface generally transverse to the rotation axis. The lateral cutting surface is the surface defined by the plurality of segments 412, 414 and 416 of the lateral blades as rotor 402 rotates. The frontal cutting surface is the surface defined by the frontal blade 410 as rotor 402 rotates.

Figure 16:
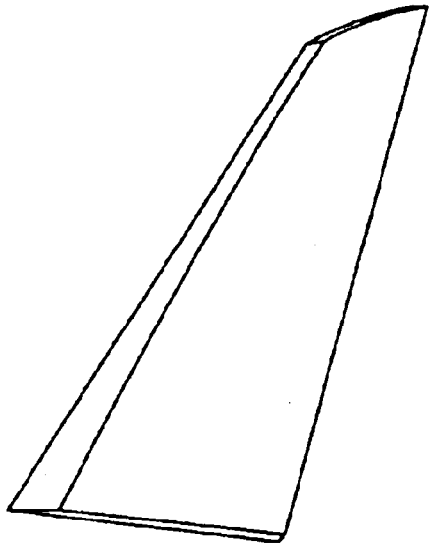
FIG. 16 is a perspective view of a blade having a cutting edge with a variable angle of attack in accordance with a specific embodiment of the present invention.

In an alternative embodiment of implementation, shown in FIG. 16, the lateral blade of cutting assembly 408 does not comprise a plurality of segments, but instead is made of a single blade having a variable angle of attack therealong. The top portion of the blade has a larger angle of attack than the bottom portion of the blade.

Although the canter chipper heads 302 and 402 are shown having only three cutting assemblies each, it should be understood that any number of cutting assemblies can be included on rotors 302 and 402 without departing from the spirit of the invention.

In addition, it should be understood that the blade sub-assemblies 212 and 214 of canter chipper head 200 could be substituted by either of blade sub-assemblies 308 and 408, described in relation to canter chipper heads 300 and 400, respectively.

Although various embodiments have been illustrated, this was for the purpose of describing, but not limiting, the invention. Various modifications will become apparent to those skilled in the art and are within the scope of this invention, which is defined more particularly by the attached claims.

What is claimed is:

1. A canter chipper head, comprising:

a) a rotor suitable for rotation about a rotation axis;

b) said rotor having a lateral side and a frontal side;

c) first and second cutting assemblies mounted to said rotor, during rotation of said rotor about said rotation axis;

i) said first cutting assembly defining a first lateral cutting surface around the rotation axis and a first frontal cutting surface that is generally transverse to the rotation axis; said first lateral cutting surface and said first frontal cutting surface performing a primary cut in a log;

ii) said second cutting assembly defining a second lateral cutting surface around the rotation axis and a second frontal cutting surface that is generally transverse to the rotation axis, said second lateral cutting surface and said second frontal cutting surface performing a secondary cut in the log that is deeper than the primary cut.

2. A canter chipper head as defined in claim 1, wherein said first cutting assembly includes at least one blade on said lateral side and at least one blade on said frontal side.

3. A canter chipper head as defined in claim 2, wherein said second cutting assembly includes at least one blade on said lateral side and at least one blade on said frontal side.

4. A canter chipper head as defined in claim 3, wherein said first lateral cutting surface is a frusto-conical shaped surface.

5. A canter chipper head as defined in claim 4, wherein said second lateral cutting surface is a frusto-conical shaped surface.

6. A canter chipper head as defined in claim 5, wherein said second lateral cutting surface is offset radially inwardly with relation to said first lateral cutting surface.

7. A canter chipper head as defined in claim 6, wherein said first lateral cutting surface is offset in a direction along the rotation axis with relation to said second lateral cutting surface.

8. A canter chipper head as defined in claim 7, wherein said first frontal cutting surface is offset radially outwardly with relation to said first frontal cutting surface.

9. A canter chipper head as defined in claim 8, wherein said first frontal cutting surface is offset in a direction along the rotation axis with relation to said second frontal cutting surface.

10. A canter chipper head as defined in claim 8, wherein said first frontal cutting surface is a generally annular shaped surface.

11. A canter chipper head as defined in claim 10 wherein said second frontal cutting surface is a generally annular shaped surface.

12. A canter chipper head as defined in claim 9, wherein said first cutting assembly has three blades on said lateral side.

13. A canter chipper head as defined in claim 10, wherein said first cutting assembly has three blades on said frontal side.

14. A canter chipper head as defined in claim 11, wherein said second cutting assembly has three blades on said lateral side.

15. A canter chipper head as defined in claim 12, wherein said second cutting assembly has three blades on said frontal side.

16. A canter chipper head as defined in claim 13, wherein said rotor includes a plurality of chip discharging apertures.

17. A canter chipper head, comprising:

a) a rotor suitable for rotation about a rotation axis;

b) said rotor having a lateral side and a frontal side;

c) a cutting assembly mounted to said rotor, during rotation of said rotor about said rotation axis;

d) said cutting assembly defining a lateral cutting surface around the rotation axis that is a frusto-conical shaped surface, and a frontal cutting surface, said frontal cutting surface having:

i) a radially inward cutting surface that is an annular shaped surface that is generally transverse to the rotation axis; and ii) a radially outward cutting surface that is a frusto-conical shaped surface;

e) said lateral cutting surface defining a smaller angle with relation to the rotation axis than said radially outward cutting surface;

f) said radially outward cutting surface performing a first frontal cut in a log;

g) said radially inward cutting surface performing a second frontal cut in the log deeper than the first frontal cut.

18. A canter chipper head as defined in claim 17, wherein said cutting assembly includes a frontal blade defining said frontal cutting surface and a lateral blade defining said lateral cutting surface, said frontal blade including a radially outward segment defining the radially outward cutting surface of said frontal cutting surface and a radially inner segment defining the radially inner cutting surface of said frontal cutting surface.

19. A canter chipper head as defined in claim 18, wherein said radially outward segment is slanted backwardly relative to said radially inner segment about a direction of rotation of said rotor about the rotation axis.

20. A canter chipper head as defined in claim 19, wherein said lateral blade being angularly offset from the radially inward segment of said frontal blade, the radially outward segment of said frontal blade extending from the radially inward segment of said frontal blade to said lateral blade.

21. A canter chipper head as defined in claim 18, wherein said cutting assembly includes a plurality of frontal blades angularly spaced from one another, each frontal blade including a radially inward segment and a radially outward segment slanted backward relative to the radially inner segment about a direction of rotation of said rotor about the rotation axis.

22. A canter chipper head as defined in claim 21, wherein said cutting assembly includes a plurality of lateral blades angularly spaced from one another.

* * * * *